US006813998B2

(12) United States Patent
Roebuck

(10) Patent No.: US 6,813,998 B2
(45) Date of Patent: Nov. 9, 2004

(54) PAD PRINTING MACHINE

(76) Inventor: Malcolm J. Roebuck, 429 E. North Water St., Chicago, IL (US) 60611

( * ) Notice: Subject to any disclaimer, the term of this patent is extended or adjusted under 35 U.S.C. 154(b) by 4 days.

(21) Appl. No.: 10/331,041

(22) Filed: Dec. 28, 2002

(65) Prior Publication Data

US 2004/0123749 A1 Jul. 1, 2004

(51) Int. Cl.[7] ..... B41F 17/00
(52) U.S. Cl. ..... 101/41; 101/35; 101/163
(58) Field of Search ..... 101/35, 41, 163, 101/167, 169

(56) References Cited

U.S. PATENT DOCUMENTS

| | | | | |
|---|---|---|---|---|
| 1,657,237 A | | 1/1928 | Talbot | |
| 2,002,847 A | * | 5/1935 | Atti | 101/381 |
| 4,163,421 A | * | 8/1979 | Sihota | 101/41 |
| 4,779,531 A | * | 10/1988 | Ueno et al. | 101/163 |
| 4,905,594 A | | 3/1990 | Phillip et al. | |
| 5,119,724 A | * | 6/1992 | Ng | 101/41 |
| 5,272,973 A | | 12/1993 | Chojnacki | |
| 5,476,040 A | | 12/1995 | Kleist | |
| 5,662,041 A | | 9/1997 | Kleist | |
| 5,921,177 A | * | 7/1999 | Shin | 101/163 |

OTHER PUBLICATIONS

Service Tectonics Model 606; Machine seen at www.pad-printing.net; date unknown, prior to present invention.

"Press–A–Print"; machine seen at www.pressaprint.com; date unknown, prior to present invention.

* cited by examiner

*Primary Examiner*—Andrew H. Hirshfeld
*Assistant Examiner*—Kevin D. Williams
(74) *Attorney, Agent, or Firm*—Greer, Burns & Crain, Ltd.; Philip M. Kolehmainen

(57) ABSTRACT

A printing plate is supported on a table slideably mounted on a frame for forward and back horizontal movement. A table lever has a handle moving in a vertical plane to slide the table for inking an image on the plate with an inverted ink cup or for moving the inked image under a printing pad. A printing pad shaft is supported by a mast for vertical sliding movement of the printing pad down onto the inked image or onto a work piece supported by a work holder bracket adjustably attached to the table. A printing pad lever has a handle moving in a second vertical plane to move the printing pad shaft. A printing cycle includes a minimum number of sequential movements of the two handles in parallel vertical planes located side by side.

17 Claims, 4 Drawing Sheets

PAD PRINTING MACHINE

FIELD THE INVENTION

The present invention relates to pad printing machines and more particularly to a simple, manually operated, convenient to use pad printing machine.

DESCRIPTION OF THE PRIOR ART

Printing machines having a deformable printing pad are used for printing images onto work pieces. Because the deformable pad can assume three dimensional shapes, pad printing machines can be used with a variety of work pieces including, for example, key fobs, golf balls, drinking mugs and glasses, and many other work pieces of small or large size.

Most known and commercially available pad printing machines are expensive and complex, often motorized machines intended for large volume, commercial operations. U.S. Pat. Nos. 4,905,594; 5,272,973 and 5,662,041 disclose examples of such complex, automated machines.

It would be desirable to provide an inexpensive, simple pad printing machine that is easy for a single person to operate manually, with one hand if desired. Past attempts to provide a simple, conveniently operated manual machine have not been successful. U.S. Pat. No. 1,657,237 discloses a relatively simple machine for printing watch dials. The machine disclosed in this patent is not practical for modern pad printing operation because, among other reasons, it requires manual application of ink with a putty knife or the like and because it lacks a mechanism for easily moving the printing plate.

A "PRESS-A-PRINT" machine available from Press-A-Print, 1463 Commerce Ave., Idaho Falls, Id. 83401 is believed to be an attempt to provide a simple, convenient, manually operated pad printing machine. This machine is subject to disadvantages including the necessity to rotate a head assembly including a printing pad between horizontally spaced locations, and the necessity to manually apply ink to a printing plate with a brush-like or roller-like tool.

A Model 606 machine available from Service Tectonics, 2827 treat Hwy., Adrian, Mich. 49221 is believed also to be an attempt to provide a simple, manually operated pad printing machine. This machine is subject to disadvantages including the necessity for the user to manipulate three different handles moving in different directions in a complex sequence of numerous steps during each printing cycle.

SUMMARY OF THE INVENTION

A principal object of the present invention is to provide an improved pad printing machine. Other objects are to provide a pad printing machine that is suited for convenient manual operation; that can be operated easily by a single user with one or two hands; that requires a minimum of sequential operations during each printing cycle; that can be set up and operated easily and quickly without the need for special tools or complicated or sensitive adjustments; and to provide a pad printing machine that overcomes problems with known pad printing machines.

In brief, in accordance with the invention there is provided a pad printing machine including a frame with a base having a front and rear extending in an X direction and spaced apart in a Y direction. The frame includes a mast extending upward from the base in a Z direction. A table is mounted to the base for sliding movement. The table includes a printing plate holder and a work piece holder. A printing pad shaft support is mounted upon the mast and supports a printing pad shaft for sliding motion in the Z direction. A pad linkage is connected between the frame and the pad shaft and includes a pad lever mounted for pivoting motion relative to the frame for moving the shaft in response to movement of the pad lever. The pad lever includes a free end portion having a pad handle spaced from the frame. The pad handle is movable in a first Y-Z plane. A table lever is mounted for pivoting motion relative to the frame. A table linkage is coupled between the table lever and the table for moving the table in response to movement of the table lever. The table lever has a free end portion including a table handle spaced from the frame and movable in a second Y-Z plane spaced in the X direction from the first Y-Z plane.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
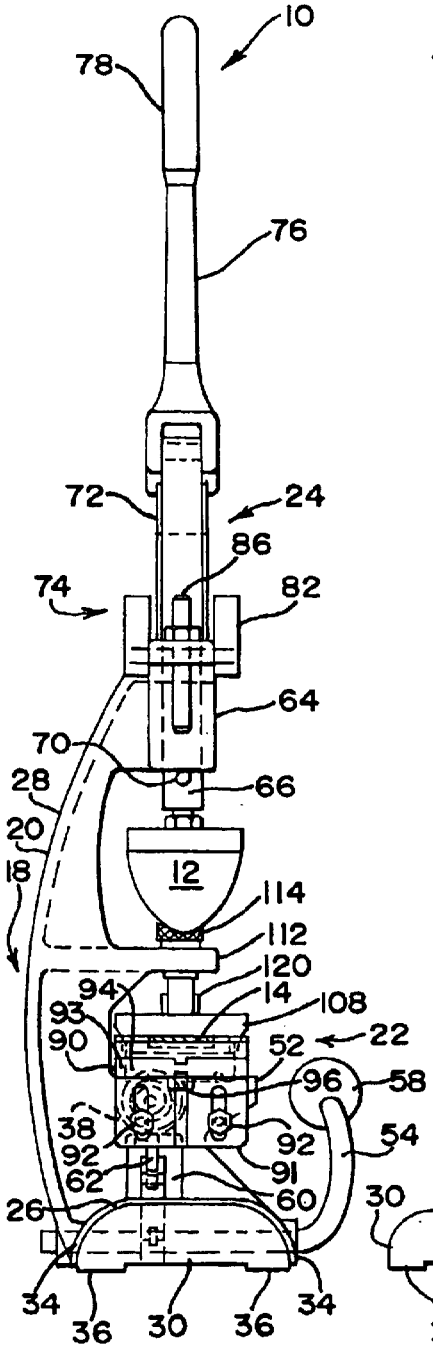
FIG. 1 is a front view of a pad printing machine embodying the present invention.
Figure 2:
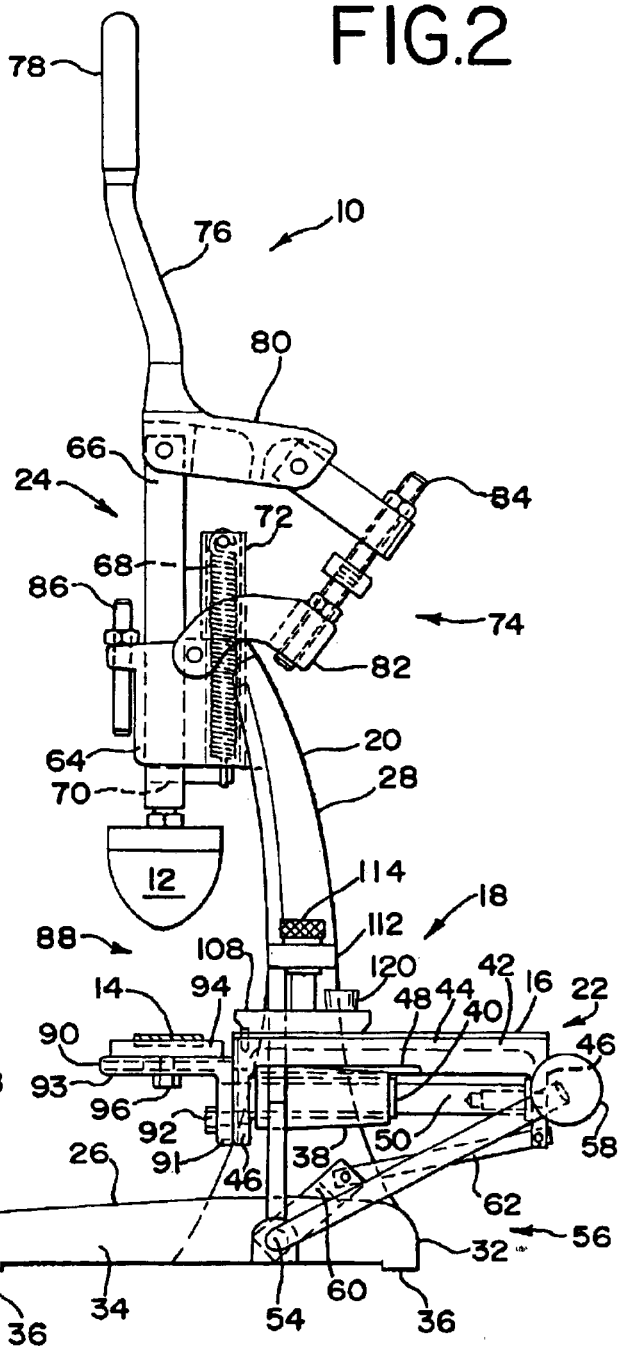
FIG. 2 is a side view of the pad printing machine of FIG. 1.

Having reference now to the drawings, and initially to FIGS. 1 and 2, there is illustrated a pad printing machine constructed in accordance with the principles of the present invention and generally designated by the reference numeral 10. The pad printing machine 10 uses a deformable printing pad 12 to print an image onto a work piece 14 using ink applied to a printing plate 16 from an ink cup assembly 18. Pad 12 is formed of a soft, deformable material such as silicone and is able to conform to three-dimensional objects, compound angles and the like. In general, the machine 10 includes a frame 20 supporting the ink cup assembly 18 as well as a table assembly 22 and printing pad assembly 24.

The frame 20 is preferably a unitary cast aluminum part having a base portion 26 and an upstanding mast portion 28. The base 26 has forward and rear edges 30 and 32 extending side to side in a horizontal X direction, from side to side in the front view of FIG. 1. Opposed side edges 34 extend horizontally front to back in an orthogonal Y direction. The mast 28 extends in an orthogonal, vertical Z direction, upwardly from one side of the base 26. If desired, the base 26 may be provided with non slip feet 36 to assist in holding the machine 10 securely on a support table or bench.

The frame 20 includes a table support boss 38 supporting the table assembly 22 for sliding movement, front to rear in the Y direction. The boss 38 may be an integral part of the cast frame 20 and is located upon the lower portion of the mast 28. The boss 38 includes an elongated opening extending in the Y direction, and, if desired for reducing friction, a bearing or bushing 40 of nylon or the like may be received within the boss 38.

A table 42 of the table assembly 22 includes a flat, horizontal top portion 44. A pair of end flanges 46 extend downward from the front and rear edges of the top 44, and a pair of side flanges 48 extend downward from the side edges of the top 44. A support bar 50 is attached between the end flanges 46, extending in the Y direction. The support bar 48 is slideably captured within the bushing 40, and the bottoms of the side flanges are slideably supported and positioned by a table support arm 52 of the frame 40 (FIG. 1). The arm 52 extends in the X direction from the mast 28 at generally the elevation of the top of the bushing 40. Forward and rear stop positions of the table assembly are determined by engagement of the end flanges 46 with the boss 38 and/or the bushing 40.

Figure 7:
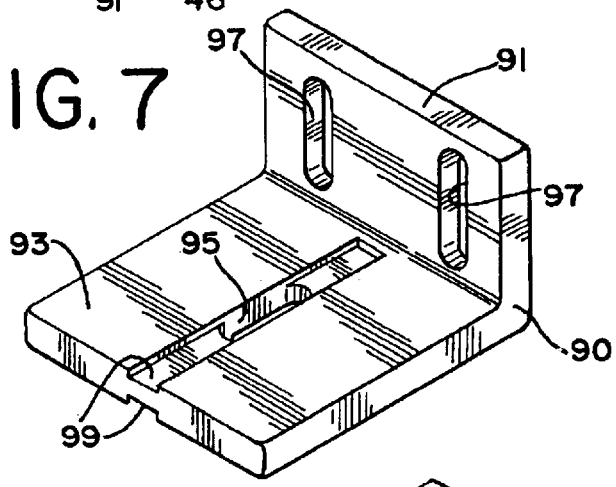
FIG. 7 is an isometric view of the work holder bracket of the pad printing machine in an inverted position for supporting large work pieces.
Figure 8:
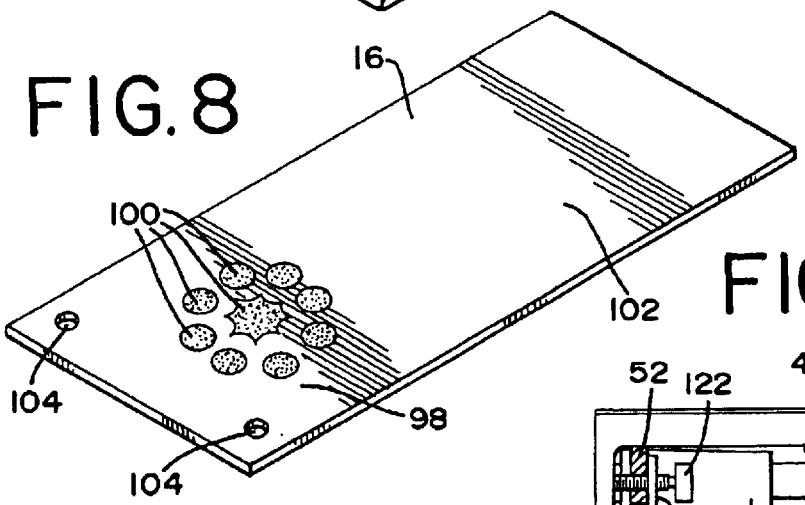
FIG. 8 is an isometric view of a printing plate of the pad printing machine.
Figure 9:
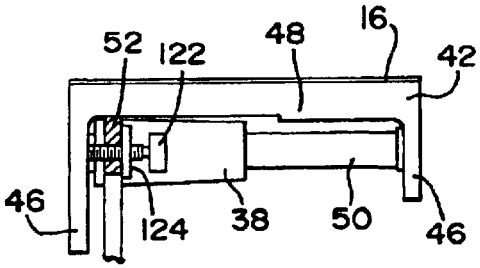
FIG. 9 is a simplified, fragmentary view, partly in section, showing a second embodiment of the invention.

FIG. 9 illustrates an alternative embodiment of the invention including an adjustable forward table stop. Most of the structure seen in FIG. 9 is the same as seen in FIGS. 1–8, and similar reference numerals are used for corresponding structure. In the FIG. 9 arrangement, an adjustable stop 122 includes a male threaded shank received in a threaded opening in the table support arm 52. A knurled head is rotated so that the user can select a precise table rear stop position. When the correct position is obtained, the stop 122 is locked with a knurled lock nut 144.

A table lever 54 and table linkage 56 move the table assembly 22 between its forward (FIGS. 3 and 4) and rear (FIGS. 1, 2 and 5) positions. The lever 54 is journaled for rotation between the side edges 34 of the base 26. A hand grip 58 carried by the free end of the lever 54 serves as a table handle. When the lever 54 pivots between positions, the table handle 58 moves in a first vertical Y-Z plane located at one side of the machine 10. The table linkage 56 includes a lower link 60 fixed to the lever 54 between the side edges 34, and an upper link 62 pivotally connected between the link 60 and the rear end flange 46 of the table 42. When the handle 58 is pushed to the rear (FIGS. 1, 2 and 5) the table assembly 22 moves to its rear position. When the handle 58 is pulled forward (FIGS. 3 and 4), the table assembly 22 moves to its forward position. The lever 54 and linkage 56 provide a mechanical advantage, reducing the force needed for moving the table assembly 22.

A printing pad shaft support boss 64 is oriented in the vertical, Z direction and is located at or near the top of the mast 28 of the frame 20. The boss 64 may be an integral part of the cast frame 20, and includes a vertically oriented elongated opening. The printing pad assembly 24 includes a printing pad support shaft 66 received in the boss 64 for vertical sliding movement in the Z direction between upper (FIGS. 1–3) and lower (FIGS. 4 and 5) positions. A coiled tension return spring 68 connected between a pin 70 on the shaft 66 and the top of a enclosure tube 72 normally holds the shaft 66 in its upper position. The printing pad 12 is attached to the bottom of the vertically movable shaft 66.

A pad linkage assembly 74 including a pad lever 76 moves the shaft 66 and pad 12 from the upper to the lower position. Lever 76 has a free end portion with a hand grip 78 forming a pad handle. The opposite end portion of the pad lever 76 forms a link 80 of the pad linkage assembly 74. One end of link 80 is pivotally connected to the upper portion of shaft 66 and the opposite end is pivotally connected to an adjustable link 82. A double ended screw 84 having one reverse screw thread is rotated to alter the effective length of the adjustable link 82. An adjustable stop 86 is engaged by the lever 76 and determines the lowermost position of the shaft 66 and pad 12.

When the pad lever pivots, the pad handle 78 moves in a second vertical Y-Z plane centrally located with respect to the machine 10, spaced in the X direction from and parallel to the plane of movement of the table lever handle 58. When the pad lever handle 78 is pulled down and forward toward the front of the machine 10, the force of the return spring 68 is overcome and the linkage assembly 74 moves the shaft 66 and printing pad 12 to the lower position. When the force on the handle 78 is reduced, the return spring 68 lifts the shaft 66 and pad 12, returning them to their upper position. The lever 76 and linkage assembly 74 provide a mechanical advantage, reducing the force needed for moving the pad assembly 24.

A work piece holding assembly 88 of the table assembly 22 positions the work piece 14 for printing. A work holder bracket 90 has an attachment leg 91 attached to the front end flange 46 of the table 42 by fasteners 92, and a work holder 94 is attached to a support shelf leg 93 of the bracket 90 by a fastener 96. The machine 10 can be used to print work pieces of many sizes and shapes. In the illustrated embodiment the work piece 14 is a disk, and the work holder 94 is configured to nest the disk 14. The work piece holding assembly 88 is adjustable in order to support and position other work pieces of other sizes and shapes, for example golf balls, mugs, drinking glasses and so forth.

For a given work piece, a different work holder, tailored to the specific work piece, may be used. A fastener such as fastener 96 can be used to attach any selected work holder to the support shelf leg 93 of the work holder bracket 90. As seen in FIG. 7, the bracket 90 has slots 97 that permit the bracket 90 to be attached by the fasteners 92 at various elevations at the front of the table 42. The elevation of the bracket 90 and holder 94 can be varied in accordance with the height of a specific work piece. Fastener 96 extends through a slot 95 so that the work piece holder can be adjusted forward and back.

To provide an even greater range of adjustability, the bracket 90 can be removed and reattached in an inverted position. The work holder bracket 90 is shown in the inverted position in FIG. 7. In the inverted position, even relatively large work pieces can be accommodated. The work holder 94 or other work holder can be keyed into either of two opposed slots 99 in the opposed faces of the support shelf leg 93, depending on the orientation of the work holder bracket 90. In addition, the work holder bracket 90 can be omitted, and a work holder can be attached directly to the front table flange 46 by the fastener 92. The position of the work holder and work piece relative to the printing pad 12 is determined by the adjustable stop 122.

As best seen in FIG. 8, the printing plate 16 is a thin, planar rectangle of sheet material. The top surface of the plate 16 includes a forward, image bearing region 98 provided with a desired image recess pattern 100 and a rearward ink cup rest region 102. The plate 16 at its forward end includes a pair of alignment and attachment holes 104. Pins 106 (FIG. 6) inserted into mating holes in the table top 44 mate with the holes 104 to releasably hold and precisely position the printing plate 16 on the table 42.

Figure 6:
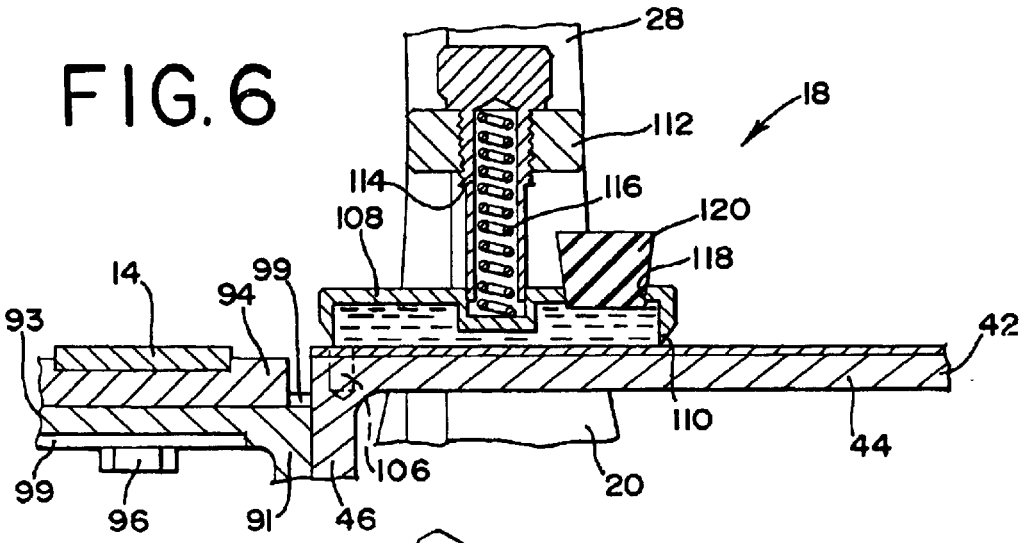
FIG. 6 is an enlarged sectional view of the ink cup assembly of the pad printing machine.

The ink cup assembly, best seen in FIG. 6, includes an ink cup 108 having a sharp edge 110 at its rim. The cup may preferably be formed as a molded part of Delrin or similar plastic, or of steel. The cup 108 is inverted and the rim 110 contacts the top surface of the printing plate 16. Frame 20 includes an ink cup support arm 112 projecting from the mast 28. A hollow screw 114 is threaded through the arm 112, and a biasing spring 116 is held in compression within screw 114 between the screw 114 and the ink cup 108 to apply a predetermined biasing force downwardly against the ink cup 108. Ink is received into the interior of the cup 108 through an opening 118 normally closed by a stopper 120. The ink is captured by spring loaded contact of the edge 110 against the surface of the printing plate 16. The plate surface within the cup 108 is flooded with ink. When the image recess pattern 100 is under the ink cup 108, the image pattern recess 100 is filled with ink.

In order to set up the machine for operation, a printing plate 16 is prepared with a desired image recess pattern which is formed in the image bearing forward region 98 of the plate 16, and the plate 16 is mounted upon the table 42 with the pins 106 in engagement with the holes 104 in the plate. This precisely orients the plate 16 and image 100 with respect to the machine 10, and assures that the plate 16 slides forward and back in the Y direction with the table assembly 22.

Figure 5:
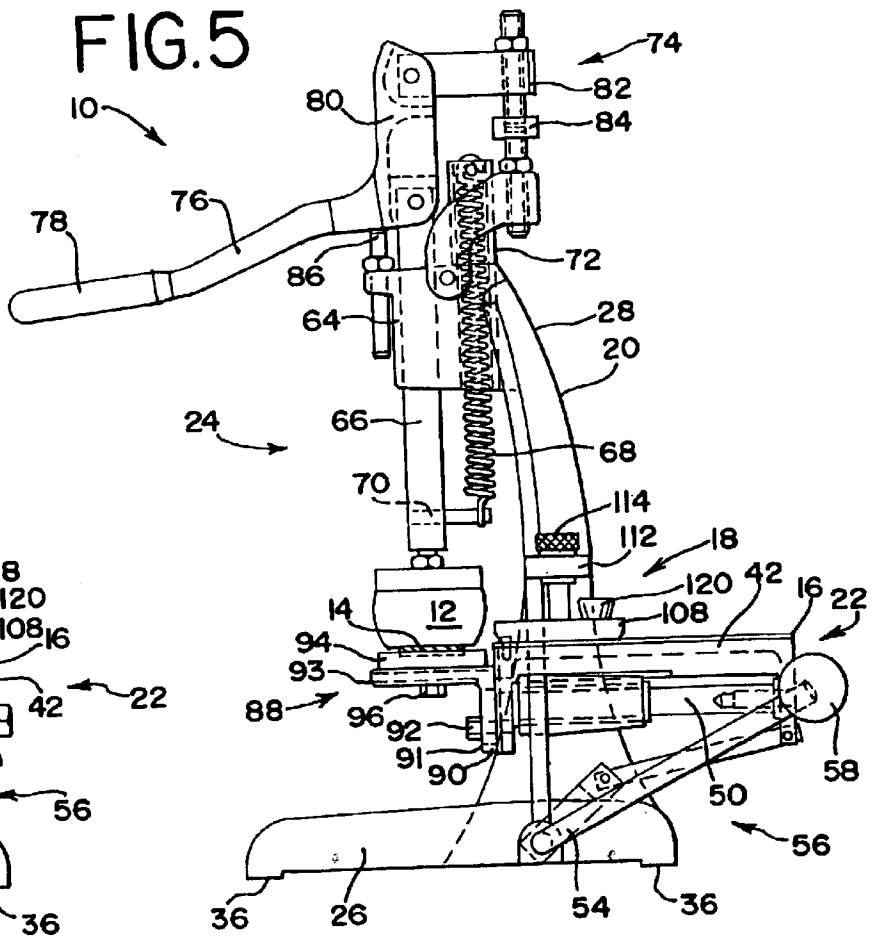
FIG. 5 is a side view of the pad printing machine, similar to FIG. 2, with the table assembly returned to its rearward position and with the printing pad lowered against the work piece.
Figure 4:
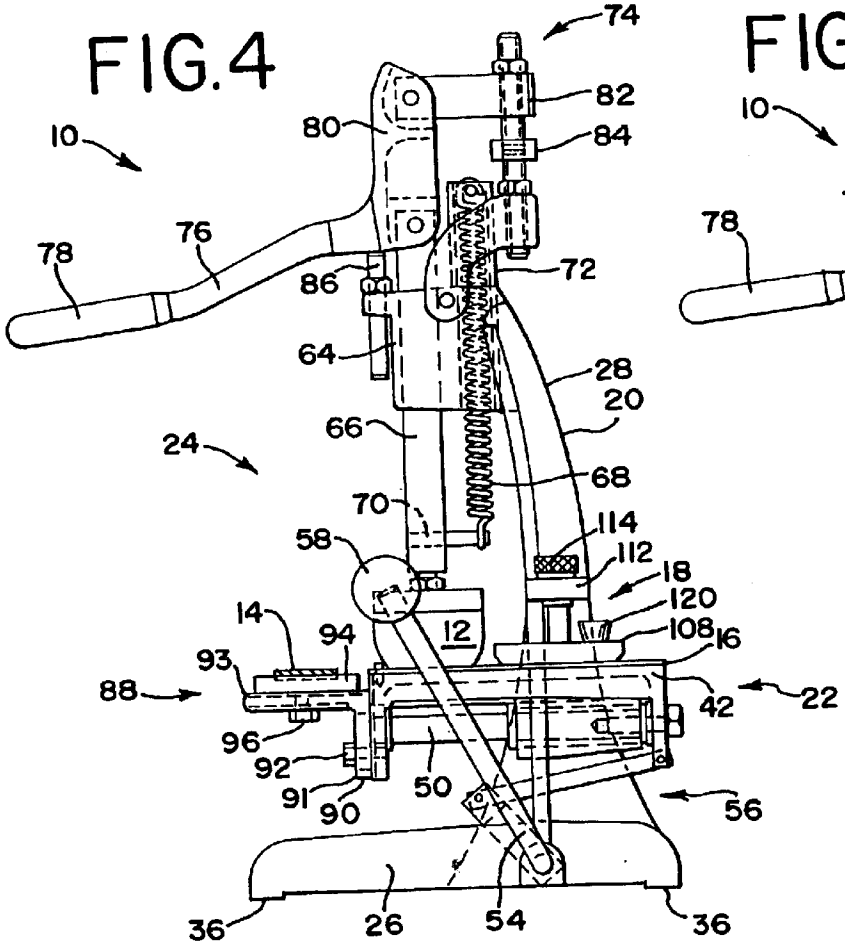
FIG. 4 is a side view of the pad printing machine, similar to FIG. 3, with the printing pad lowered against the printing plate.

The adjustable link 82 and/or the adjustable stop 86 are adjusted as needed to provide the correct range of movement of the printing pad assembly 24. The pad 12 should move downward to a lowermost position as seen in FIG. 4 in which the pad 12 resiliently flattens and contacts the image bearing region 98 of the printing plate 16 sufficiently to pick up ink from the image 100. The work piece holding assembly 88 is set up for a desired work piece. A work holder 94 is selected to hold the desired work piece 14, and is positioned and attached to bracket 90 using fastener 96 in slot 95. The bracket is inverted if desired and attached to provide the correct work piece elevation using fasteners 92 and slots 97. The work piece should be elevated so that when the printing pad 12 is fully lowered as seen in FIG. 5, the ink image is fully transferred to the work piece. The adjustable stop 122 can be used to position the work piece under the printing pad 12, for example when the work piece bracket 90 is omitted and a work piece is secured directly to the table 22.

The ink cup assembly is installed. The cup is inverted and placed onto the printing plate 16 with the edge 110 against the plate surface. The biasing spring 116 and hollow screw 114 are installed. When the screw 114 is threaded home into the cup support arm 112 as seen in FIG. 6, a predetermined spring force is applied downwardly against the cup 108 to capture ink within the cup 108 with the sharp edge 110. Ink is poured into the cup 108 through the opening 118 and the opening is closed with stopper 120. The machine 110 is now set up for printing operation.

A printing operation is easily and conveniently performed by a single user positioned at the front of the machine 10. In a printing cycle, the first step is to load a work piece 14 onto the work holder 94. Initially the machine is in the condition illustrated in FIGS. 1 and 2. The printing pad 12 and shaft 66 are held in the upper position by the return spring 68. The table assembly 22 is in its rearward position. A work piece 14 is placed onto the work holder 94 at the front of the table assembly 22. If it is desired to have more space above the work holder 94, the table can be moved to its forward position for loading (see FIG. 3), and then returned to the rearward position (FIGS. 1 and 2), but normally this extra operation is not required. In the initial position of FIGS. 1 and 2 the image area 98 of the printing plate 16 is under the ink cup 108 and ink contained within the cup fills the image recess pattern 100.

Figure 3:
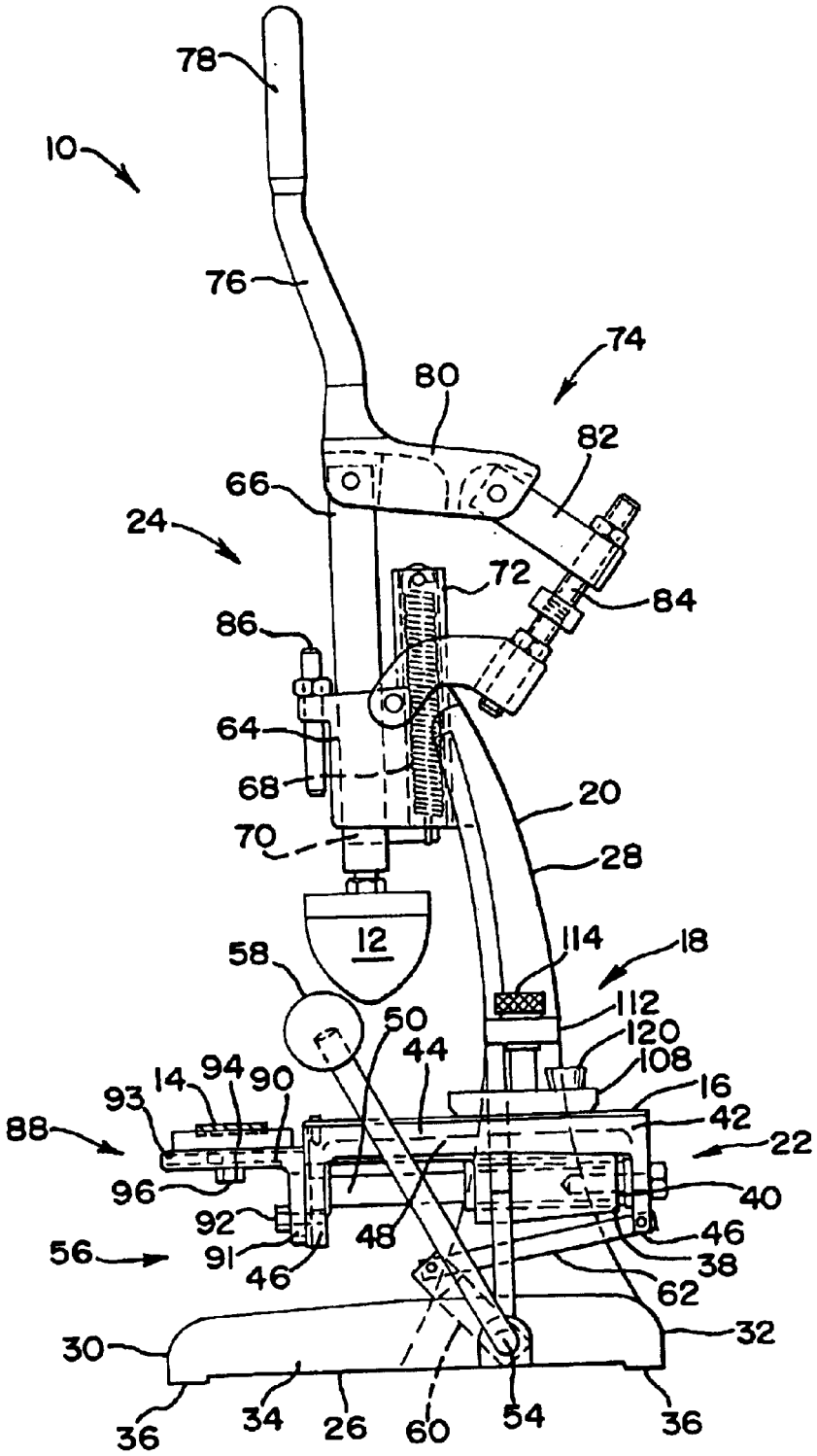
FIG. 3 is a side view of the pad printing machine, similar to FIG. 2, with the table assembly moved to its forward position to align the inked image on the printing plate with the printing pad.

The next step is to move the table assembly forward from its rear to its forward position of FIG. 3. The table handle 58 is readily at hand to a user at the front of the machine and can easily be pulled forward, typically with the right hand. The linkage 56 provides a force amplification mechanical advantage to slide the table forward. The sharp edge 110 of the ink cup 108 wipes ink from the surface of the printing plate 16, leaving ink in the image recess 100. The rearward cup rest region 102 of the plate 16 moves under the ink cup 108, and continuing contact of the edge 110 with the plate surface holds the ink within the cup 108. In the forward position of FIG. 3, the ink filled image recess pattern 100 is located directly below the raised printing pad 12.

Next, the user pulls the pad handle 78 forward and down. The handle 78 is easily grasped by either hand of the user. The machine can be operated by a single hand or by both hands. In either case, the side by side, parallel locations of the vertical Y-Z planes of handle movement, and the mechanical advantages of the linkages 56 and 74, make it easy and non tiring to move the handles 58 and 78, even throughout many successive printing cycles. In response to forward and down movement of the handle 78, the shaft 66 and pad 12 descend, and the pad 12 engages the image bearing region 98 of the plate 16 as seen in FIG. 4. The ink from the image recess pattern 100 adheres to the flattened pad surface.

The user permits the return spring 68 to raise the pad 12 and shaft 66 upwardly from the lower position, back to the position of FIG. 3. At this point in the printing cycle, an ink image is present on the surface of the raised printing pad 12. The user manipulates the table handle 58, moving it rearward, so that the table linkage 56 slides the table assembly 22 rearward to the position of FIGS. 1 and 2. In this forward position, the work piece 14 is positioned directly below the inked printing pad 12. The handle 78 is manipulated again to lower the pad 12 down onto the work piece as seen in FIG. 5. The ink image is printed from the pad 12 onto the work piece 14. When the pad 12 and shaft are returned to their upper position (FIGS. 1 and 2) the printing operation is complete and the work piece 14 is removed from the work holder 94 in preparation for the next printing cycle.

The machine 10 is convenient and easy to use. Set up of the machine is quick and easy. All fasteners and lock nuts can be provided with knurled surfaces in place of wrenching flats, and no tools are needed. There are no complex or difficult or hard to reach adjustments. A single user in front of the machine can operate the machine and easily and quickly load unprinted work pieces and remove printed work pieces. The relatively few handle manipulations performed during a printing cycle are convenient and easy to achieve, either one or two handed at the discretion of the user. An inexperienced user can quickly and reliably achieve good printing results with a minimum of training or effort.

While the present invention has been described with reference to the details of the embodiments of the invention shown in the drawing, these details are not intended to limit the scope of the invention as claimed in the appended claims.

What is claimed is:

1. A pad printing machine comprising:

a frame including a base having a front and rear extending in an X direction and spaced apart in a Y direction, said frame including a mast extending upward from the base in a Z direction;

a table mounted to said base for sliding movement, said table including a printing plate holder and a work holder;

a printing pad shaft;

a printing pad shaft support mounted upon said mast, said shaft being supported in said shaft support for sliding motion in the Z direction;

a pad linkage including at least one pivotal pad link connected between said frame and said pad shaft;

said pad linkage including a pad lever connected to said pivotal pad link and mounted for pivoting motion relative to said frame for moving said shaft in response to movement of said pad lever;

said pad lever including a free end portion including a pad handle spaced from said frame, said pad handle being movable in a first Y-Z plane;

a table lever mounted for pivoting motion relative to said frame;

a table linkage providing a mechanical advantage for moving said table with a table handle and including at least one pivotal table link coupled between said table lever and said table for moving said table in response to movement of said table lever; and said table lever having a free end portion including said table handle spaced from said frame and movable in a second Y-Z plane spaced in the X direction from said first Y-Z plane.

2. A pad printing machine as claimed in claim 1, said printing pad shaft support comprising a bushing extending in the Z direction.

3. A pad printing machine as claimed in claim 2, said pad lever being pivotally connected to an upper end of said printing pad shaft.

4. A pad printing machine as claimed in claim 3, further comprising a printing pad supported at the lower end of said printing pad shaft.

5. A pad printing machine as claimed in claim 1, said pad lever being movable between an upper position extending in generally the Z direction and a lower position extending in generally the Y direction.

6. A pad printing machine as claimed in claim 1, said table being mounted to said frame for sliding movement in the Y direction.

7. A pad printing machine as claimed in claim 6, further comprising a printing plate supported on said printing plate holder of said table.

8. A pad printing machine as claimed in claim 7, said printing plate being elongated in the Y direction and including a printing image at the forward portion of said elongated printing plate.

9. A pad printing machine as claimed in claim 8, further comprising an inverted ink cup supported at a fixed X-Y location and having a rim contacting said printing plate.

10. A pad printing machine as claimed in claim 9 further comprising an ink cup support extending from said mast and a spring between said ink cup support and said ink cup for biasing said ink cup rim toward said printing plate.

11. A pad printing machine as claimed in claim 10, further comprising a spring holder mounted to said ink cup support and movable between two positions for alternatively loading or freeing said spring.

12. A pad printing machine as claimed in claim 9 further comprising an ink loading opening in said ink cup spaced from said rim.

13. A pad printing machine comprising:

a frame including a base having a front and rear extending in an X direction and spaced apart in a Y direction, said frame including a mast extending upward from the base in a Z direction;

a table mounted to said base for sliding movement in the Y direction, said table including a printing plate holder and an adjustable work holding assembly;

a printing pad shaft;

a printing pad shaft support mounted upon said mast, said shaft being supported in said shaft support for sliding motion in the Z direction;

a pad linkage connected between said frame and said pad shaft;

said pad linkage including a pad lever mounted for motion relative to said frame for moving said shaft in response to movement of said pad lever;

said pad lever including a free end portion including a pad handle spaced from said frame, said pad handle being movable in a first Y-Z plane;

a table lever mounted for motion relative to said frame;

a table linkage coupled between said table lever and said table for moving said table in response to movement of said table lever;

said table lever having a free end portion including a table handle spaced from said frame and movable in a second Y-Z plane spaced in the X direction from said first Y-Z plane; and said adjustable work holding assembly including a work holder and a mounting assembly including at least one first slot and at least one first releasable fastener for adjustably mounting said work holder to said table for movement in the Z direction.

14. A pad printing machine as claimed in claim 13, said work holder being invertably mounted to said table.

15. A pad printing machine as claimed in claim 13, said adjustable work holding assembly further comprising at least one second slot and at least one second releasable fastener for mounting said work holder to said table for movement in a plane perpendicular to the Z direction.

16. A pad printing machine as claimed in claim 15, said adjustable work holding assembly including a bracket attached to said table by said at least one first slot and said at least one first releasable fastener, and said work holder being attached to said bracket by said at least one second slot and said at least one second releasable fastener.

17. A pad printing machine comprising:

a frame including a base having a front and rear extending in an X direction and spaced apart in a Y direction, said frame including a mast extending upward from the base in a Z direction;

a table mounted to said base for sliding movement, said table including a printing plate holder and a work holder;

a printing pad shaft comprising a bushing extending in the Z direction;

a printing pad shaft support mounted upon said mast, said shaft being supported in said shaft support for sliding motion in the Z direction;

a pad linkage connected between said frame and said pad shaft;

said pad linkage including a pad lever mounted for pivoting motion relative to said frame for moving said shaft in response to movement of said pad lever, said pad lever being pivotally connected to an upper end of said printing pad shaft, said pad linkage including a link connected between said pad lever and said frame;

said pad lever including a free end portion including a pad handle spaced from said frame, said pad handle being movable in a first Y-Z plane;

a table lever mounted for pivoting motion relative to said frame;

a table linkage coupled between said table lever and said table for moving said table in response to movement of said table lever;

said table lever having a free end portion including a table handle spaced from said frame and movable in a second Y-Z plane spaced in the X direction from said first Y-Z plane; and said link being adjustable in effective length.

* * * * *